US005327743A

United States Patent [19]

Coltrin

[11] Patent Number: 5,327,743

[45] Date of Patent: Jul. 12, 1994

[54] SUB COOLING CONDENSATE TRAP WITH EASILY REMOVABLE LID

[75] Inventor: Jed A. Coltrin, Hollidaysburg, Pa.

[73] Assignee: Enerjed, Inc., Duncansville, Pa.

[21] Appl. No.: 55,501

[22] Filed: Apr. 30, 1993

Related U.S. Application Data

[63] Continuation-in-part of Ser. No. 963,077, Oct. 19, 1992, abandoned.

[51] Int. Cl.[5] ..... F25B 47/00

[52] U.S. Cl. ..... 62/279; 62/285; 165/163

[58] Field of Search ..... 62/278, 279, 285, 503, 62/305, 277; 165/163

[56] References Cited

U.S. PATENT DOCUMENTS

| | | | |
|---|---|---|---|
| 2,712,086 | 6/1955 | Winograd | 165/163 |
| 2,722,809 | 11/1955 | Morrison | 62/279 |
| 3,996,764 | 12/1976 | Gilmer | 62/279 |
| 4,370,864 | 2/1983 | Wessa | 62/279 |
| 5,113,668 | 5/1992 | Wachs, III et al. | 62/305 |

*Primary Examiner*—John M. Sollecito

*Attorney, Agent, or Firm*—Armstrong, Westerman, Hattori, McLeland & Naughton

[57] ABSTRACT

A sub cooling condensate trap as an auxiliary unit for an air conditioning system, comprising a container having a heat exchange coil disposed therein and through which hot liquid refrigerant is passed, and water inlet and outlets in the container through which condensate water from the air conditioner condenser is passed countercurrently to the refrigerant, thereby sub cooling the refrigerant and increasing the power usage efficiency of the air conditioning system.

5 Claims, 1 Drawing Sheet

SUB COOLING CONDENSATE TRAP WITH EASILY REMOVABLE LID

This application is a continuation-in-part of application Ser. No. 07/963,077, filed Oct. 19, 1992, for Air Conditioner Add On or Replacement Trap Unit, now abandoned.

BACKGROUND OF THE INVENTION

1. Field of the Invention

The present invention relates to air conditioning apparatus and more particularly to an improved method and apparatus for sub cooling liquid refrigerant before it is released to the evaporator through the expansion valve or other control device in an air conditioning system.

Known methods and apparatus for using condensate to cool liquid refrigerant are designed and built as an integral part of the air conditioning apparatus, and generally feature a heat exchanger coil located in the drain pan under the evaporator. These methods and apparatus introduce the problem of reintroducing heat and vapors created in the heat exchange process into the air conditioned space. In addition, a heat exchanger coil located in the drip pan complicates maintenance when cleaning or other maintenance procedures are required.

2. Description of Related Prior Art

U.S. Pat. No. 3,996,764 to Gilmer et al. discloses a window air conditioner wherein warm refrigerant is cooled in a cooling coil immersed in a separate reservoir of cold condensate before releasing the refrigerant to the evaporator. This method applies only to window air conditioners and must be designed and built into the window unit. There is no outside separate container the condensate water.

U.S. Pat. No. 2,722,809 discloses a refrigerator construction in which warm refrigerant is cooled by passing it through coils immersed in an open drip pan containing condensate. This apparatus is not applicable to a split system air conditioner.

U.S. Pat. No. 2,296,997 discloses a method wherein condensate is collected in a drip pan and is led therefrom to an open pan in which a coil containing warm refrigerant is immersed. This method requires extensive changes in piping and air flow and is aimed primarily at the disposal of condensate water.

U.S. Pat. No. 3,355,908 discloses a method for cooling refrigerant by passing it through a coil in a drip pan. This method has the disadvantage of reintroducing heat into the conditioned space. Furthermore, it is not an auxiliary device which can be added to an existing air conditioning system to improve efficiency.

U.S. Pat. No. 3,691,786 discloses a method for cooling liquid refrigerant which is not an auxiliary device and which, in spite of complicated design features, does not completely eliminate the reintroduction of heat into the air conditioned space.

U.S. Pat. No. 4,250,717 discloses the use of tap water and condensate water to cool a condenser coil and the compressor. This is essentially a water cooled condenser for an air conditioning system, not an auxiliary device for an air cooled system.

U.S. Pat. No. 4,370,864 discloses the use of condensates supplement tap water in a water cooled ice machine. The method is not applicable to air cooled air conditioning apparatus.

SUMMARY OF THE INVENTION

It is an object of the present invention to provide apparatus which can be used as a replacement for the normal trap in the condensate drain line of an air conditioning system. Such apparatus also provides means for cooling liquid refrigerant.

Another object of the invention is to provide a method for increasing efficiency which will not increase the possibility of evaporator freeze up. Current practice in design to improve efficiency consists mainly of increasing the effectiveness of the condenser by making it larger. During periods of low load and/or low outside ambient temperature, an oversize condenser can produce low pressure problems which can cause freeze up. The present invention provides maximum sub cooling when the load is high and minimum sub cooling when the load is low.

Still another object of the present invention is to provide a method and apparatus which is separate from the basic air conditioning system and can therefore be added to an existing air conditioning system as a auxiliary device for the purpose of increasing efficiency.

Still another object of the present invention is to provide a simple refrigerant sub cooling device which, when installed, is located outside the enclosure for the evaporator, thus preventing the reintroduction of heat from the heat exchange process into the air conditioned space.

Still another object of the present invention is to provide a construction which is very accessible when cleaning or when other maintenance is required.

In its simplest form the present invention comprises a container equipped with condensate and refrigerant inlet and outlet lines, and a coil of refrigerant tubing. The device serves as a combination condensate trap and heat exchanger and is readily substituted for the usual condensate trap in a new installation, or can be added as an auxiliary device to improve efficiency in an existing air conditioning system.

The drawings are illustrative only and some changes to the preferred embodiment would be obvious to one skilled in the art.

DESCRIPTION OF THE PREFERRED EMBODIMENT

Figure 1:
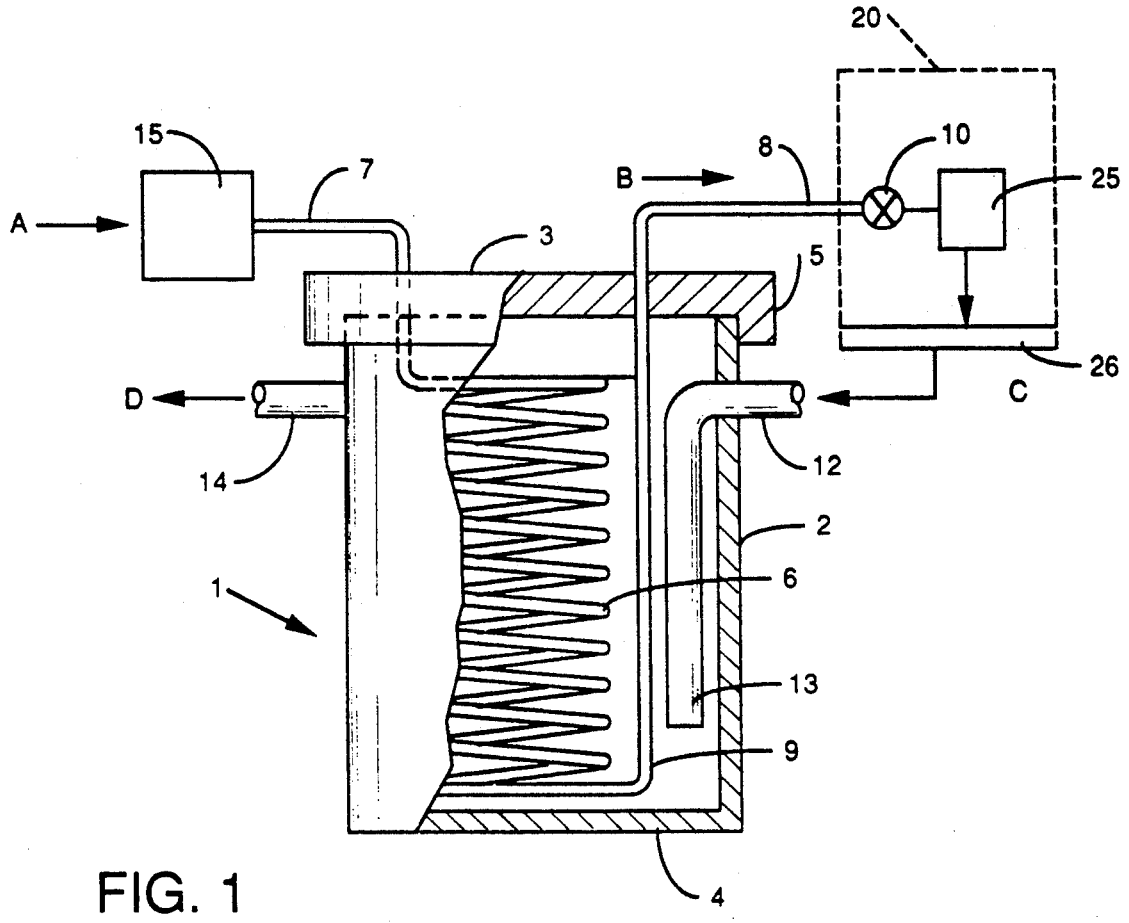
FIG. 1 is a side elevation, partly in cross section, of the sub cooling trap unit according to the invention.

As shown in FIG. 1, the sub cooling condensate trap according to the invention comprises a container generally denoted by the numeral 1, made of any suitable material, and has sidewalls 2, bottom wall 4 and a lid or topwall 3. Passing through the sidewalls 2 is a water inlet 12 which may comprise a dip tube portion 13, providing means for conducting water from the drip pan 26 of the evaporator 25 to the container 1. Also shown is a water outlet 14 passing through the sidewalls 12 and providing means for conducting water to a drain. Water will flow through these elements in the direction C-D.

Disposed within the container 1 is a heat exchanger coil 6 having an inlet end 7 which, as shown, may pass through the lid 3 and through which coil may be passed in the direction A-B a hot liquid refrigerant from a condenser unit 15 of an air conditioning apparatus and to an expansion valve or other control unit 10 of the air conditioner evaporator 25 which, with drip pan 26 and condenser 15 is to be understood as being disposed within an enclosing housing, a portion of which 20 about the evaporator 26 is shown in FIG. 1. The coil 6 may have a straight portion 9 rising from near the bottom of the container where the helical coil terminates and extending through the lid 3 to the outlet end 8 and control device 10.

Figure 2:
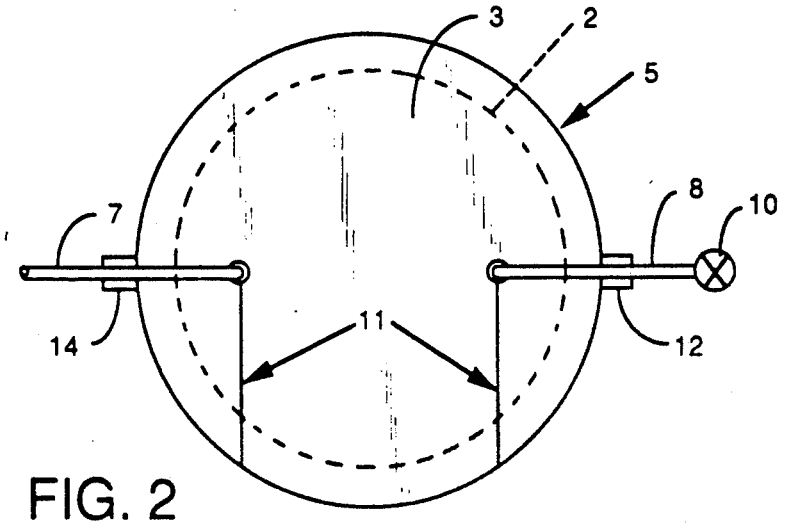
FIG. 2 is a top plan view of the unit shown in FIG. 1.

Topwall or lid 3 is made of pliable material such as a suitable plastic. As shown in FIG. 1, the lid 3 is provided with a dependent skirt 5 adapted for a tight fit about sidewalls 2. As shown in FIG. 2, lid 3 also has a pair of self-sealing slits 11 extending from the periphery of the lid to apertures therein through which pass refrigerant inlet and outlet lines 7 and 8. These latter lines rise above the top surface of the lid 3 a sufficient distance so that the lid may be lifted to disengage the skirt 5 from about sidewalls 2 and then moved horizontally so that lines 7 and 8 pass through the slits 11, whereby the lid 3 is easily removed for cleaning or maintenance of the sub cooling unit without disturbing the coil inlet 7 and the coil outlet 8.

In operation, the heat exchange trap will fill with cold condensate water from the evaporator and will cool the refrigerant introduced into the coil 6 from the condenser. This sub cooling of the refrigerant reduces head pressure at the compressor and thus reduces power consumption. Tests have produced power savings from 5% to 12% under varying conditions.

What is claimed is:

1. Apparatus for countercurrent sub cooling warm refrigerant from a condenser in an air conditioning system with cold condensate water from an evaporator disposed within an enclosure in said air conditioning system, comprising:

a. an elongated container disposed outside the evaporator enclosure and having sidewalls, a bottom wall and a removable lid, said lid is provided with means for easy removal including being fabricated from a pliably material;

b. water inlet and outlet means including first conduit means for connecting said water inlet means to a cold water outlet of a drip pan under the evaporator, and second conduit means connecting said water outlet means to a drain; and c. an elongated helical heat exchange coil disposed in said container and including third conduit means for connecting an upper end of said coil to a warm refrigerant outlet of the condenser, and fourth conduit means for connecting a lower end of said coil to a control device on an evaporator side of the air conditioning system, whereby warm refrigerant is cooled by cold condensate water in countercurrent flow of refrigerant and water through the apparatus.

2. Apparatus according to claim 1, wherein the apparatus is an auxiliary device for retrofit incorporation in an existing air conditioning system outside an air flow pattern for air conditioned space.

3. Apparatus according to claim 1, wherein the lid of the container is provided with slits extending from a periphery of the lid to apertures in the lid thigh which extend the first and second conduit means whereby, on lifting the lid from engagement with the sidewalls of the container, the first and second conduit means may be passed through said slits to remove the lid from the container for cleaning and maintenance without disturbing the first and second conduit means.

4. Apparatus according to claim 2, wherein the lid of the container is provided with slits extending from a periphery of the lid to apertures in the lid through which extend the first and second conduit means whereby, on lifting the lid from engagement with the sidewalls of the container, the first and second conduit means may be passed through said slits to remove the lid from the container for cleaning and maintenance without disturbing the first and second conduit means.

5. Apparatus according to claim 3 which is a nonintegral part of an existing air conditioning system, but is added thereto as an auxiliary device to conserve energy used in operation of the air conditioning system.

* * * * *